US008393720B2

(12) United States Patent
Devries et al.

(10) Patent No.: US 8,393,720 B2
(45) Date of Patent: Mar. 12, 2013

(54) FLUID DISPENSING APPARATUS

(75) Inventors: Mark A. Devries, Albany, OR (US); Norman Pawlowski, Corvallis, OR (US); Dan Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 13/259,990

(22) PCT Filed: Aug. 4, 2009

(86) PCT No.: PCT/US2009/052712

§ 371 (c)(1),
(2), (4) Date: Sep. 23, 2011

(87) PCT Pub. No.: WO2011/016801

PCT Pub. Date: Feb. 10, 2011

(65) Prior Publication Data

US 2012/0019605 A1 Jan. 26, 2012

(51) Int. Cl.
*B41J 2/175* (2006.01)

(52) U.S. Cl. ..... 347/85

(58) Field of Classification Search ..... 347/6, 42, 347/84, 85, 86, 87; 222/544
See application file for complete search history.

(56) References Cited

U.S. PATENT DOCUMENTS

| | | | | |
|---|---|---|---|---|
| 6,457,818 | B1 | 10/2002 | Kurashima et al. | |
| 6,464,346 | B2 | 10/2002 | Otis et al. | |
| 6,672,706 | B2 | 1/2004 | Silverbrook | |
| 6,942,316 | B2 | 9/2005 | Scheffelin et al. | |
| 7,344,231 | B2 * | 3/2008 | Talon et al. | 347/85 |
| 7,357,496 | B2 * | 4/2008 | Silverbrook et al. | 347/86 |
| 7,416,272 | B2 | 8/2008 | Silverbrook et al. | |
| 7,527,355 | B2 * | 5/2009 | Lee et al. | 347/49 |
| 8,113,612 | B2 * | 2/2012 | Levy et al. | 347/6 |
| 2006/0152560 | A1 | 7/2006 | Sami et al. | |
| 2009/0141093 | A1 | 6/2009 | Lee et al. | |

OTHER PUBLICATIONS

International Search Report and Written Opinion received in PCT Application No. PCT/US2009/052712, mailed on Apr. 1 , 2010, pp. 11.

* cited by examiner

*Primary Examiner* — Anh T. N. Vo

(57) ABSTRACT

A fluid dispensing apparatus including a fluid ejector unit having a plurality of nozzles and extending in a lengthwise direction to form a dispensing area to correspond with a width of a substrate, the fluid ejector unit configured to eject fluid through the nozzles to the dispensing area, a plurality of modular regulator members configured to regulate fluid to a predetermined pressure range and to provide the regulated fluid to a corresponding set of nozzles of the fluid ejector unit, the modular regulator members are arranged in the lengthwise direction such that each of the modular regulator members are adjacent to at least one other modular regulator member, and a fluidic channel unit having at least one fluid inlet and a plurality of fluid channels configured to provide fluid to the respective modular regulator members.

15 Claims, 3 Drawing Sheets

FLUID DISPENSING APPARATUS

BACKGROUND

Fluid dispensing systems such as inkjet printing systems print images on a substrate such as paper by ejecting ink in the form of drops from an inkjet print head. Large format inkjet printers and/or pagewide inkjet printers that include long inkjet print heads or long inkjet print bars are becoming more popular due to an increase in large format printing applications.

BRIEF DESCRIPTION OF THE DRAWINGS

Exemplary non-limiting embodiments of the present general inventive concept are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific embodiments in which the general inventive concept may be practiced. It is to be understood that other embodiments may be utilized and structural or logical changes may be made without departing from the scope of the present general inventive concept. The following detailed description, therefore, is not to be taken in a limiting sense, and the scope of the present general inventive concept is defined by the appended claims.

Fluid dispensing systems such as inkjet printing systems to perform large format printing applications are becoming more in demand as the need for large format printing applications increase. In particular, applications using wider substrates in which to eject ink onto facilitate a need to increase a length of long inkjet print heads and long inkjet print bars. Generally, however, increasing the length of the print heads and print bars tend to result in large pressure variations from end to end of the print head and print bar. Particularly, when the print head and print bar are oriented with a long axis pointed vertically as might occur during handling or shipping. Further, although negative pressure is needed to prevent leaking, too large of a negative pressure can adversely affect print quality under normal printing conditions. Thus, in the present embodiment of the present general inventive concept, the print heads and print bars are lengthened by having them include a plurality of discrete fluidic sections each referenced by its own pressure regulation device which may be housed in a single assembly.

Figure 1:
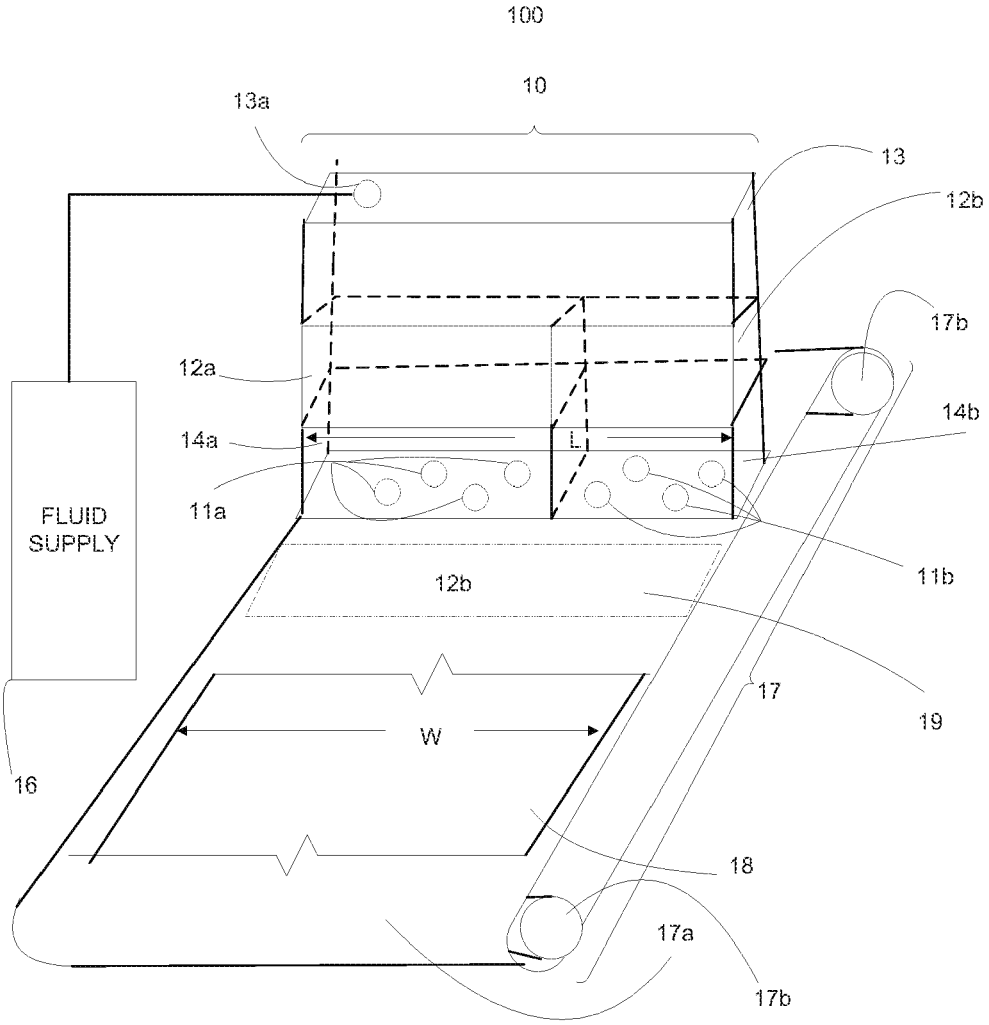
FIG. 1 is a perspective view illustrating a fluid dispensing system according to an embodiment of the present general inventive concept.
Figure 2:
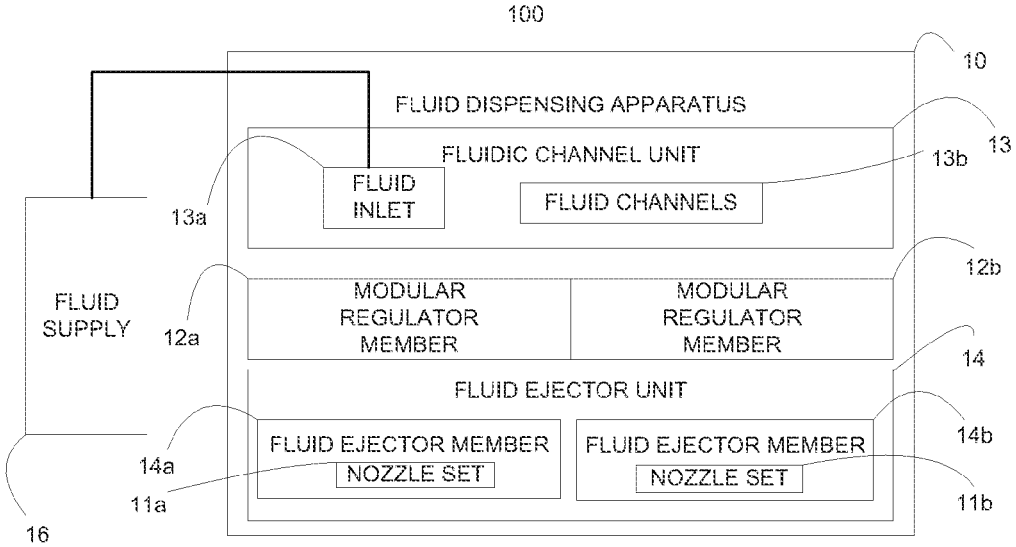
FIG. 2 is a block diagram illustrating the fluid dispensing system of FIG. 1 according to an embodiment of the present general inventive concept.

FIG. 1 is a perspective view illustrating a fluid dispensing system according to an embodiment of the present general inventive concept. FIG. 2 is a block diagram illustrating the fluid dispensing system of FIG. 1 according to an embodiment of the present general inventive concept. Referring to FIGS. 1 and 2, in the present embodiment, a fluid dispensing system 100 includes a fluid dispensing apparatus 10, a fluid supply 16 and a substrate transporting unit 17. In one embodiment, the fluid dispensing system 100 may be an inkjet printing system and the fluid dispensing apparatus 10 may be an inkjet print head such as a long inkjet print head and/or a long inkjet print bar. In the present embodiment, the fluid dispensing apparatus 10 includes a fluid ejector unit 14 including a plurality of fluid ejector members 14*a* and 14*b* having one or more sets of nozzles 11*a* and 11*b*, and a fluidic channel unit 13 having at least one fluid inlet 13*a* and a plurality of fluid channels 13*b*.

Referring to FIG. 1, the substrate transporting unit 17 may include a transport belt 17*a* and transport rollers 17*b* in contact with the transport belt 17*a*. In the present embodiment, the transport belt 17*a* is configured to transport a substrate 18 such as paper to and from a dispensing area 19 corresponding to the fluid dispensing apparatus 10, and transport rollers 17*b* are configured to move the transport belt 17*a*. In other embodiments, the substrate transporting unit 17 may include a transporting drum, a platen, or any other substrate transporting member to transport a substrate to and from a dispensing area of a fluid dispensing apparatus known to one of ordinary skill in the art.

In the present embodiment, as illustrated in FIGS. 1 and 2, the fluid ejector unit 14 includes the plurality of fluid ejector members 14*a* and 14*b* arranged in a lengthwise direction such that each of the fluid ejector members 14*a* and 14*b* are adjacent to at least one other fluid ejector member. Each of the fluid ejector members 14*a* and 14*b* may include one or more sets of nozzles 11*a* and 11*b* extending in a lengthwise direction to form a dispensing area 19 such as a printable area, for example, to correspond with a width of the substrate 18. The fluid ejector unit 14 is configured to selectively eject fluid through the nozzles 11*a* and 11*b* to the dispensing area 19, for example, when the substrate 19 is located therein. A corresponding set of nozzles from one or more fluid ejector members 14*a* and 14*b* correspond to and are in fluid communication with a respective modular regulator member 12*a* and 12*b*. In one embodiment, each of the corresponding sets of nozzles corresponding with a respective modular regulator member are different from each other. That is, none of the individual nozzles of the plurality of nozzles 11 are in more than one corresponding set of nozzles 11*a* and 11*b*.

For example, a corresponding set of nozzles may be all the nozzles from one fluid ejector member such as a monochrome fluid ejector member that ejects fluid of a single color. Thus, as illustrated in FIGS. 1 and 2, fluid ejector member 14*a* includes one set of nozzles 11*a*. In this embodiment, for example, modular regulator member 12*a* corresponds with and is in fluid communication with the corresponding nozzle set 11*a*. In another embodiment, the corresponding set of nozzles may include a set of nozzles from more than one fluid ejector member 14*a* and 14*b* (FIG. 3) as each of the fluid ejector members 14*a* and 14*b* may include a plurality of sets of nozzles $\mathbf{11}a_1$, $\mathbf{11}b_1$, $\mathbf{11}c_1$ $\mathbf{11}d_1$ and $\mathbf{11}a_2$, $\mathbf{11}b_2$, $\mathbf{11}c_2$and $\mathbf{11}d_2$ such as a multicolor fluid ejector member that ejects several colors of fluid. Thus, the corresponding set of nozzles may be a nozzle set from each of the fluid ejector members

14*a* and 14*d*. For example, the corresponding set of nozzles corresponding to the respective modular regulator member 12*a* may include nozzle sets $\mathbf{11}a_1$ and $\mathbf{11}a_2$, the corresponding set of nozzles corresponding to the respective modular regulator member 12*b* may include nozzle sets $\mathbf{11}b_1$ and $\mathbf{11}b_2$ the corresponding set of nozzles corresponding to the respective modular regulator member 12*c* may include nozzle sets $\mathbf{11}c_1$ and $\mathbf{11}c_2$, and the corresponding set of nozzles corresponding to the respective modular regulator 12*d* may include nozzle sets $\mathbf{11}d_1$ and $\mathbf{11}d_2$.

Referring to FIGS. 1 and 2, the modular regulator members 12*a* and 12*b* are arranged in the lengthwise direction, for example, corresponding to the length L of the fluid ejector unit 14 such that each of the modular regulator members 12*a* and 12*b* are adjacent to at least one other modular regulator member 12*a* and 12*b*. Thus, pressure variation in each of the modular regulator members 12*a* and 12*b*, for example, due to orientation and handling will be the same as if the respective modular regulator members 12*a* and 12*b* existed individuals, rather than as one elongated regulator. Each of the plurality of modular regulator members 12*a* and 12*b* are configured to regulate fluid to a predetermined pressure range and to provide the regulated fluid to the corresponding set of nozzles 11*a* and 11*b* of one or more of the fluid ejector members 14*a* and 141*b* For example, the modular regulator members 12*a* and 12*b* regulate the fluid to prevent drool through the nozzles 11*a* and 11*b* of the fluid ejector unit 14, while preventing excessive de-priming of the fluid dispensing apparatus 10. In the present embodiment, the predetermined pressure range is, but not limited to, −0.5 inches of water pressure to −30 inches of water pressure including −3 inches of water pressure to −15 inches of water pressure. The fluidic channel unit 13 includes at least one fluid inlet 13*a* and a plurality of fluid channels 13*b* configured to provide fluid to the respective modular regulator members 12*a* and 12*b*.

In one embodiment, each of the modular regulator members 12*a* and 12*b* include a housing to contain a regulating member such as foam, an inflatable bladder, or any other regulating member known to one of ordinary skill in the art to regulate fluid to a predetermined pressure range. The housing may also include an inlet to receive fluid, an outlet to output regulated fluid and attachment members to attach the respective modular regulator member to one or more adjacent modular regulator members.

In one embodiment, at least one fluid inlet 13*a* of the fluidic channel unit 13 is connected to a fluid supply 16 configured to supply fluid to the fluidic channel unit 13. The fluid supply 16 may include one or more containers to store a fluid. The fluid may include, for example, ink including any type of pigment or colorant such as toner, or other type of image forming material. The ink may be in a variety of forms such as liquid and semi-liquid, or other forms used in conjunction with printing systems to print images on a substrate. In one embodiment, the fluid may be ink corresponding to one or more colors. The containers maybe include removable containers or fixed containers such as ink cartridges, aerosol cans or any other fluid supply known to one of ordinary skill in the art. For example, in one embodiment, the fluid supply 16 may include a removable ink cartridge containing a single color of ink such as black. In other embodiments, the fluid supply 16 may be multiple ink cartridges each containing a different color ink such as, but not limited to, cyan, magenta, yellow, blue and black. Thus, in one embodiment, the plurality of fluid channels 13*b* of the fluidic channel unit 13 may each correspond with a respective color of ink of the fluid supply 16 and a respective modular regulator member 12*a* and 12*b*. In other embodiments, the plurality of fluid channels 13*b* of the fluidic channel unit 13 may each be in fluid communication with a single color of ink of the fluid supply 16 and a respective one or more of the modular regulator members 12*a* and 12*b*.

Figure 3:
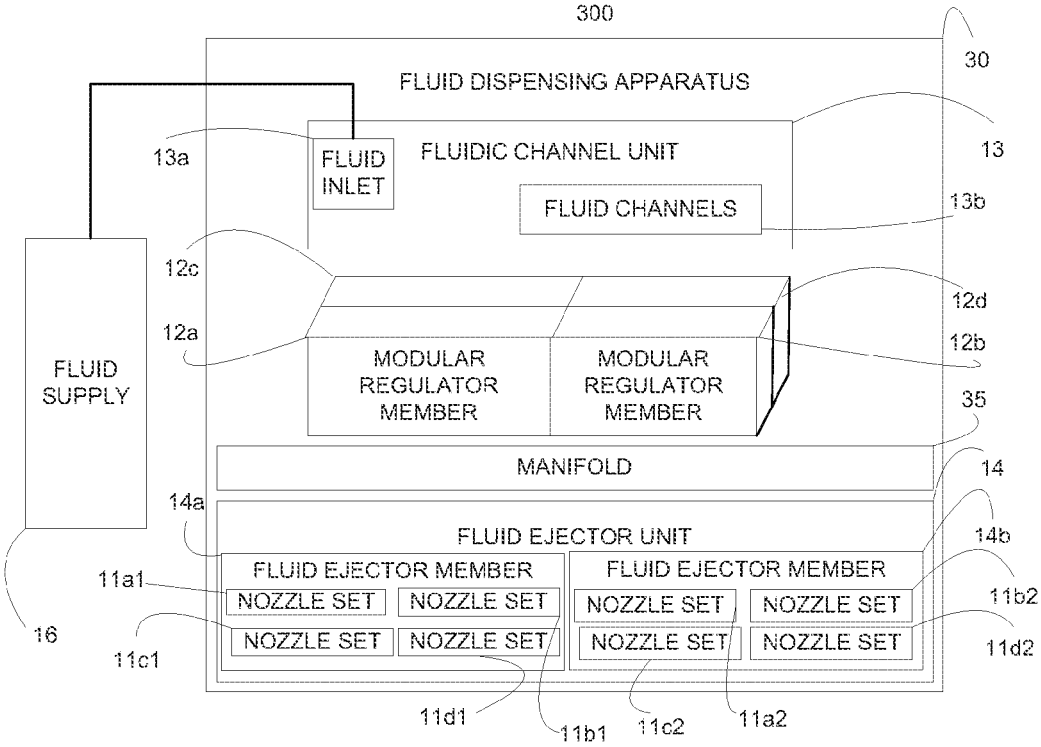
FIG. 3 is a block diagram illustrating a fluid dispensing system according to an embodiment of the present general inventive concept.

FIG. 3 is a block diagram illustrating a fluid dispensing system according to an embodiment of the present general inventive concept. Referring to FIG. 3, the fluid dispensing system 300 includes the fluid supply 16 as previously described and illustrated with respect to FIGS. 1 and 2 and a fluid dispensing apparatus 30. In the present embodiment, the fluid dispensing apparatus 30 may include the components previously described with respect to the fluid dispensing apparatus 10 of FIGS. 1 and 2, additional modular regulator members 12*c* and 12*d*, nozzle sets $\mathbf{11}a_1$, $\mathbf{11}b_1$, $\mathbf{11}c_1$, $\mathbf{11}d_1$, $\mathbf{11}a_2$, $\mathbf{11}b_2$, $\mathbf{11}c_2$, and $\mathbf{11}d_2$, and a manifold 35.

Referring to FIG. 3, a first set of modular regulator members 12*a* and 12*b* are each configured to regulate fluid to a predetermined negative pressure range and each to provide the respective regulated fluid to a corresponding set of nozzles $\mathbf{11}a_2$, and $\mathbf{11}b_1$, $\mathbf{11}b_2$ associated therewith of the fluid ejector members 14*a* and 14*b* of the fluid ejector unit 14. In the present embodiment, the predetermined negative pressure range is, but not limited to, −0.5 inches of water pressure to −30 inches of water pressure including −3 inches of water pressure to −15 inches of water pressure. The first set of modular regulator members 12*a* and 12*b* are arranged in the lengthwise direction such that each of the first set of modular regulator members 12*a* and 12*b* are adjacent to at least one other first set modular regulator member 12*b* and 12*a*, respectively, to form a first regulator row. A second set of modular regulator members 12*c* and 12*d* are each configured to regulate the fluid to the predetermined pressure range and each to provide the respective regulated fluid to a corresponding set of nozzles $\mathbf{11}c_1$, $\mathbf{11}c_2$, and $\mathbf{11}d_1$, $\mathbf{11}d_2$ associated therewith of the fluid ejector members 14*a* and 14*b* of the fluid ejector unit 14. The second set of modular regulator members 12*c* and 12*d* are arranged in the lengthwise direction such that each of the second set of modular regulator members 12*c* and 12*d* are adjacent to at least one other second set modular regulator member 12*d* and 12*c*, respectively, to form a second regulator row adjacent to the first regulator row.

In one embodiment, the manifold 35 may be disposed upstream of the fluid ejector unit 14. For example, the manifold 35 may be disposed between the fluid ejector unit 14 and the plurality of modular regulator members 12*a*, 12*b*, 12*c* and 12*d*. Thus, in the present embodiment, the manifold 35 is configured to receive the regulated fluid from each of the modular regulator members 12*a*, 12*b*, 12*c* and 12*d* and to provide the regulated fluid to the corresponding set of nozzles $\mathbf{11}a_1$, $\mathbf{11}b_1$, $\mathbf{11}c_1$, $\mathbf{11}d_1$, $\mathbf{11}a_2$, $\mathbf{11}b_2$, $\mathbf{11}c_2$, and $\mathbf{11}d_2$, of the respective fluid ejector members 14*a* and 14*b* of the fluid ejector unit 14.

For example, the manifold 35 may include a plurality of fluid channels. A first fluid channel of the manifold 35 may receive the regulated fluid from one of the first modular regulator members 12*a* and provide the regulated fluid to the corresponding set of nozzles $\mathbf{11}a_1$ and $\mathbf{11}a_2$ of the respective fluid ejector members 14*a* and 14*b*. A second fluid channel of the manifold 35 may receive the regulated fluid from another one of the first modular regulator members 12*b* and provide the regulated fluid to the corresponding set of nozzles $\mathbf{11}b_1$ and $\mathbf{11}b_2$ of the respective fluid ejector members 14*a* and 14*b*. A third fluid channel of the manifold 35 may receive the regulated fluid from one of the second modular regulator members 12*c* and provide the regulated fluid to the corresponding set of nozzles $\mathbf{11}c_1$ and $\mathbf{11}c_2$ of the respective fluid ejector members 14*a* and 14*b*. A fourth fluid channel of the manifold 35 may receive the regulated fluid from another one of the second modular regulator members 12*d* and provide the regulated fluid to the corresponding set of nozzles 11$d_1$ and 11$d_2$ of the respective fluid ejector members 14*a* and 14*b*.

Figure 4:
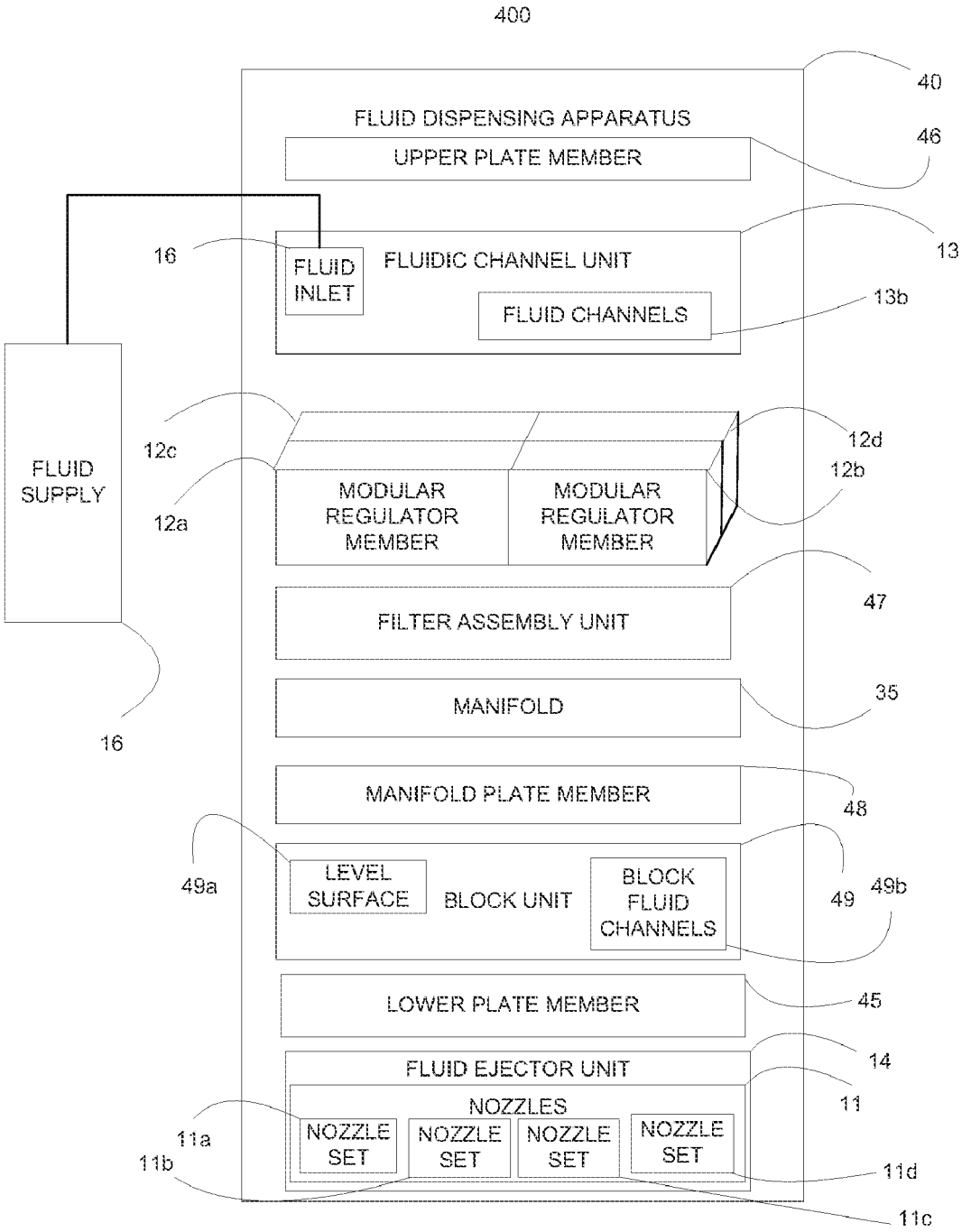
FIG. 4 is a block diagram illustrating an inkjet printing system according to an embodiment of the present general inventive concept.

FIG. 4 is a block diagram illustrating an inkjet printing system according to an embodiment of the present general inventive concept. Referring to FIG. 4, the fluid dispensing system 400 includes the fluid supply 16 as previously described and illustrated with respect to FIGS. 1-3 and a fluid dispensing apparatus 40. In the present embodiment, the fluid dispensing apparatus 40 may include the components previously described with respect to the fluid dispensing apparatuses 10 and 30 illustrated in FIGS. 1-3, an upper plate member 46, a filter assembly unit 47, a manifold plate member 48, a block unit 49 having a level surface 49*a* and a plurality of block fluid channels 49*b*, and a lower plate member 45.

In present embodiment, the upper plate member 46 is disposed on an upper surface of the fluidic channel unit 13 and forms a protective cover for the fluid dispensing apparatus 40. In one embodiment, the filter assembly unit 47 may be disposed upstream of the modular regulator members 12*a*, 12*b*, 12*c* and 12*d* and configured to filter ink, for example, provided by the fluid supply 16 and/or the fluidic channel unit 13. For example, the filter assembly unit 47 may be disposed between the fluidic channel unit 13 and the modular regulator members 12*a*, 12*b*, 12*c* and 12*d*. In another embodiment, the filter assembly unit 47 may be disposed downstream of the modular regulator members 12*a*, 12*b*, 12*c* and 12*d*, for example, to filter the regulated ink therefrom, in one embodiment, the filter assembly unit 47 may be disposed between the modular regulator members 12*a*, 12*b*, 12*c* and 12*d* and the manifold 35. The filter assembly unit 47 may include a filter assembly top, a filter assembly bottom, and a filter cartridge disposed between the filter assembly top and the filter assembly bottom.

In the present embodiment, the fluid dispensing system 400 is an inkjet printing system and the fluid dispensing apparatus 400 is an inkjet print head. The inkjet printing system includes a fluid supply 16 configured to supply ink and an inkjet print head. The inkjet print head includes a fluid ejector unit 14 having a plurality of nozzles 11 and configured to eject ink through the nozzles 11 onto a substrate 19 (FIG. 1), a plurality of rows of modular regulator members 12*a*, 12*b*, 12*c* and 12*d* each including two or more modular regulator members 12*a*, 12*b*, 12*c*, and 12*d* configured to regulate ink to a predetermined negative pressure range and to provide the regulated ink to a corresponding set of nozzles 11*a*, 11*b*, 11*c* and 11*d* of the fluid ejector unit 14 such that each of the modular regulator members 12*a*, 12*b*, 12*c*, and 12*d* are adjacent to at least two other modular regulator members, a manifold 35 disposed between the plurality of rows of modular regulator members 12*a*, 12*b*, 12*c* and 12*d* and the fluid ejector unit 14 such that the manifold 35 includes a plurality of fluid channels to transport the ink from each of the modular regulator members 12*a*, 12*b*, 12*c* and 12*d* to the respective set of nozzles 11*a*, 11*b*, 11*c* and 11*d* of the fluid ejector 14, and a fluidic channel unit 13 configured to transport the ink from the fluid supply 16 to each of the modular regulator members 12*a*, 12*b*, 12*c* and 12*d*. In the present embodiment, the predetermined pressure range is, but not limited to, −0.5 inches of water pressure to −30 inches of water pressure including −3 inches of water pressure to −15 inches of water pressure.

In one embodiment, the block unit 49 may be disposed between the manifold 35 and the fluid ejector unit 14. The block unit 49, for example, may include a level surface 49*a* and a plurality of block fluid channels 49*b* to transport the ink from the manifold 35 to the corresponding set of nozzles 11*a*, 11*b*, 11*c* and 11*d*. In addition, the manifold plate member 48 may be disposed between the manifold 35 and the block unit 49. The manifold plate member 48 may be configured to facilitate the transport of the ink from the manifold 35 to the block unit 49 to prevent the ink from leaking out from between the manifold 35 and the block unit 49. In addition, the lower plate member 45 may be coupled to the level surface 49*a* of the block unit 49. The lower plate member 45 is configured to transport the ink from the block unit 49 to the corresponding set of nozzles 11*a*, 11*b*, 11*c* and 11*d*.

In one embodiment, the fluid ejector unit 14 may include a plurality of fluid ejector members 14*a* and 14*b* (FIG. 1) arranged in the lengthwise direction such that each of the fluid ejector members 14*a* and 14*b* are adjacent to at least one other fluid ejector member and mounted on the lower plate member 45. Each of the fluid ejector members 14*a* and 14*b*, for example, may include a respective set of the plurality of nozzles 11*a* and 11*b* corresponding to and in fluid communication with a respective modular regulator member 12*a*, 12*b*, 12*c* and 12*d*. In one embodiment, each of the plurality of fluid ejector members 14*a* and 14*b* may be print head chips mounted on the lower plate member 45.

The present general inventive concept has been described using non-limiting detailed descriptions of embodiments thereof that are provided by way of example and are not intended to limit the scope of the general inventive concept, it should be understood that features and/or operations described with respect to one embodiment may be used with other embodiments and that not all embodiments of the general inventive concept have all of the features and/or operations illustrated in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the general inventive concept and which are described as examples. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A fluid dispensing apparatus, comprising:

a fluid ejector unit having a plurality of nozzles and extending in a lengthwise direction to form a dispensing area to correspond with a width of a substrate, the fluid ejector unit configured to eject fluid through the nozzles to the dispensing area;

a plurality of modular regulator members configured to regulate fluid to a predetermined pressure range and to provide the regulated fluid to a corresponding set of nozzles of the fluid ejector unit, the modular regulator members are arranged in the lengthwise direction such that each of the modular regulator members are adjacent to at least one other modular regulator member; and a fluidic channel unit having at least one fluid inlet and a plurality of fluid channels configured to provide fluid to the respective modular regulator members,

2. The apparatus according to claim 1, wherein the corresponding set of nozzles corresponding to each of the plurality of modular regulator members are different from each other.

3. The apparatus according to claim 1, wherein the fluid ejector unit comprises:

a plurality of fluid ejector members arranged in the lengthwise direction such that each of the fluid ejector members are adjacent to at least one other fluid ejector member, each of the fluid ejector members having a corresponding set of the plurality of nozzles corresponding to and in fluid communication with one or more of the modular regulator members.

4. The apparatus according to claim 1, further comprising:

a manifold disposed between the fluid ejector unit and the plurality of modular regulator members, and configured to receive the regulated fluid from each of the modular regulator members and provide the regulated fluid to the corresponding set of nozzles of the fluid ejector unit.

5. The apparatus according to claim 1, wherein the predetermine pressure range is from −0.5 inches of water pressure to −30 inches of water pressure.

6. The apparatus according to claim 1, wherein the at least one fluid inlet of the fluidic channel unit is connected to a fluid supply configured to supply fluid to the fluidic channel unit.

7. The apparatus according to claim 1, wherein the fluid dispensing apparatus comprises:

an inkjet print head.

8. A fluid dispensing apparatus, comprising:

a fluid ejector unit having a plurality of nozzles and extending in a lengthwise direction to form a dispensing area to correspond with a width of a substrate, the fluid ejector unit configured to eject fluid through the nozzles to the dispensing area;

a first set of modular regulator members configured to regulate fluid to a predetermined negative pressure range and to provide the respective regulated fluid to a corresponding not of nozzles of the fluid ejector unit, the first set of modular regulator members are arranged in the lengthwise direction such that each of the first set of modular regulator members are adjacent to at least one other first set modular regulator member forming a first regulator row;

a second set of modular regulator members configured to regulate the fluid to the predetermined pressure range and to provide the respective regulated fluid to a corresponding set of nozzles of the fluid ejector unit, the second set of modular regulator members are arranged in the lengthwise direction such that each of the second set of modular regulator members are adjacent to at least one other second set modular regulator member forming a second regulator row adjacent to the first regulator row;

a manifold disposed between the first and second set of modular pressure regulators and the fluid ejector unit, the manifold having a plurality of fluid channels to receive the fluid from the first and second set of modular regulator members and to provide the fluid to the corresponding set of nozzles of the fluid ejector unit; and a fluidic channel unit configured to receive fluid from a fluid supply and provide the fluid to the respective first and second set of modular regulator members.

9. The apparatus according to claim 8, wherein the fluid ejector unit comprises:

a plurality of fluid ejector members arranged in the lengthwise direction such that each of the fluid ejector members are adjacent to at least one other fluid ejector member, each of the fluid ejector members having a corresponding set of the plurality of nozzles corresponding to and in fluid communication with one or more of the modular regulator members, wherein the corresponding set of nozzles corresponding to each of the plurality of modular regulator members are different from each other.

10. An inkjet printing system, comprising:

a fluid supply configured to supply ink; and an inkjet printing apparatus, comprising:

a fluid ejector unit having a plurality of nozzles, and configured to eject ink through the nozzles onto a substrate;

a plurality of rows of modular regulator members each including two or more modular regulator members configured to regulate ink to a predetermined negative pressure range and to provide the regulated ink to a corresponding set of nozzles of the fluid ejector unit, each of the modular regulator members are adjacent to at least two other modular regulator members;

a manifold disposed between the plurality of rows of modular regulator members and the fluid ejector unit, the manifold having a plurality of fluid channels to transport the ink from each of the modular regulator members to the corresponding set of nozzles of the fluid ejector unit; and a fluidic channel unit configured to transport the ink from the fluid supply to each of the modular regulator members.

11. The system according to claim 10, further comprising:

a filter assembly unit disposed upstream of the modular regulator members, and configured to filter ink provided to the modular regulator members; and a block unit disposed between the manifold and the fluid ejector unit, the block unit having a level surface and a plurality of block fluid channels to transport the ink from the manifold to the corresponding set of nozzles.

12. The system according to claim 11, further comprising:

an upper plate member configured to cover an upper surface of the fluidic channel unit;

a manifold plate member disposed between the manifold and the block unit, and configured to facilitate the transport of the ink from the manifold to the block unit and preventing the ink from leaking out from between the manifold and the block unit; and a lower plate member coupled to the level surface of the block unit, and configured to transport the ink from the block unit to the corresponding set of nozzles.

13. The system according to claim 12, wherein the fluid ejector unit comprises:

a plurality of fluid ejector members arranged in the lengthwise direction such that each of the fluid ejector members are adjacent to at least one other fluid ejector member and mounted on the lower plate member, each of the fluid ejector members having a corresponding set of the plurality of nozzles corresponding to and in fluid communication with one or more of the modular regulator members.

14. The system according to claim 10, wherein the predetermined negative pressure range is from −0.5 inches of water pressure to −30 inches of water pressure.

15. The system according to claim 10, wherein the inkjet printing apparatus comprises:

an inkjet print head.

* * * * *

UNITED STATES PATENT AND TRADEMARK OFFICE

CERTIFICATE OF CORRECTION

PATENT NO. : 8,393,720 B2
APPLICATION NO. : 13/259990
DATED : March 12, 2013
INVENTOR(S) : Mark A. Devries et al.

It is certified that error appears in the above-identified patent and that said Letters Patent is hereby corrected as shown below:

In the Claims:

In column 6, line 64, in Claim 1, delete “members,” and insert -- members. --, therefor.

In column 7, line 34, in Claim 8, before “of nozzles” delete “not” and insert -- set --, therefor.

Signed and Sealed this
Twenty-seventh Day of August, 2013

Teresa Stanek Rea
*Acting Director of the United States Patent and Trademark Office*